US007301461B2

(12) United States Patent
Hu et al.

(10) Patent No.: US 7,301,461 B2
(45) Date of Patent: Nov. 27, 2007

(54) SOC FOR INTEGRATING MICRO-ANTENNA

(75) Inventors: Chuan-Ling Hu, Taipei Hsien (TW); Shun-Tian Lin, Taipei (TW); Chang-Fa Yang, Taipei (TW)

(73) Assignee: Chant Sincere Co., Ltd., Taipei Hsien (TW)

( * ) Notice: Subject to any disclaimer, the term of this patent is extended or adjusted under 35 U.S.C. 154(b) by 450 days.

(21) Appl. No.: 11/109,624

(22) Filed: Apr. 20, 2005

(65) Prior Publication Data

US 2006/0238349 A1 Oct. 26, 2006

(51) Int. Cl.
*G08B 13/14* (2006.01)

(52) U.S. Cl. ..... 340/572.7; 340/539.1; 343/845

(58) Field of Classification Search ..... 340/572.1, 340/572.9, 539.1; 455/13.3, 83; 343/790, 343/845

See application file for complete search history.

(56) References Cited

U.S. PATENT DOCUMENTS

2005/0068182 A1* 3/2005 Dunlap et al. ..... 340/572.8
2005/0124354 A1* 6/2005 Durgin ..... 455/456.1
2006/0033664 A1* 2/2006 Castany et al. ..... 343/700 MS

* cited by examiner

*Primary Examiner*—Phung T. Nguyen
(74) *Attorney, Agent, or Firm*—Bacon & Thomas, PLLC

(57) ABSTRACT

An integrating SOC capable of integrating a micro-antenna System on Chip (SOC) of integrating micro-antennas comprises an existing radio frequency model, a circuit board and an antenna element to a package of single SOC. The micro-antenna element is formed by using antenna radiated conductor paths composing of a single-feeding end or multiple-feeding ends and multiple-curved paths. Active or passive elements are selected to match up the antenna element and relative circuits, and arranges on the circuit board. Then by using embedding type injection molding or glue-filling modeling, the single SOC is finished by the package of a radio frequency model and an antenna element.

11 Claims, 3 Drawing Sheets

SOC FOR INTEGRATING MICRO-ANTENNA

BACKGROUND OF THE INVENTION (a) Field of the Invention

The present invention relates to antennas, and particularly to an SOC (System on chip) capable of integrating a micro-antenna, and in particular to integrate and package an existing radio frequency model, circuit boards and antenna elements to a single SOC.

(b) Description of the Prior Art

Chip antennas are a kind of antenna type and are developed recently. This type of antenna packages metal conductors into dielectric material. If electromagnetic wave spreads in the material having higher dielectric constant, then the wave speed will slow down for the sake of material property and the wavelength becomes shorter. The size of antenna will depend on its wavelength. If the wavelength is longer, then the size of antenna will become larger. On the other hand, if the wavelength is shorter, then the size of antenna can be smaller. If the dielectric constant of packaging material is higher, then the whole volume of antenna can be smaller. Almost all products of wireless transformation tend to a trend of compactness, so the invention of chip antenna is very useful for the future development of wireless transformation.

The prior art about radio frequency SOCs includes only a radio frequency model, and does not cover the scope of antenna. Because of the antenna characters in electromagnetic divergence and its basic required size, the prior arts implement by separating an antenna form a radio frequency model. Thus it is impossible to reach the goals of integrating the process of manufacture and making the size of the product become smaller.

SUMMARY OF THE INVENTION

The primary objective of the present invention is to provide an SOC with an integrated micro-antenna. The SOC comprises an existing radio frequency model, a circuit board and an antenna element to a package of single SOC. The micro-antenna element is formed by using antenna radiated conductor paths composing of a single-feeding end or multiple-feeding ends and multiple-curved paths. Active or passive elements are selected to match up the antenna element and relative circuits, and arranges on the circuit board. Then by using embedding type injection molding or glue-filling modeling, the single SOC is finished by the package of a radio frequency model and an antenna element.

DETAILED DESCRIPTION OF THE PREFERRED EMBODIMENTS

Figure 1:
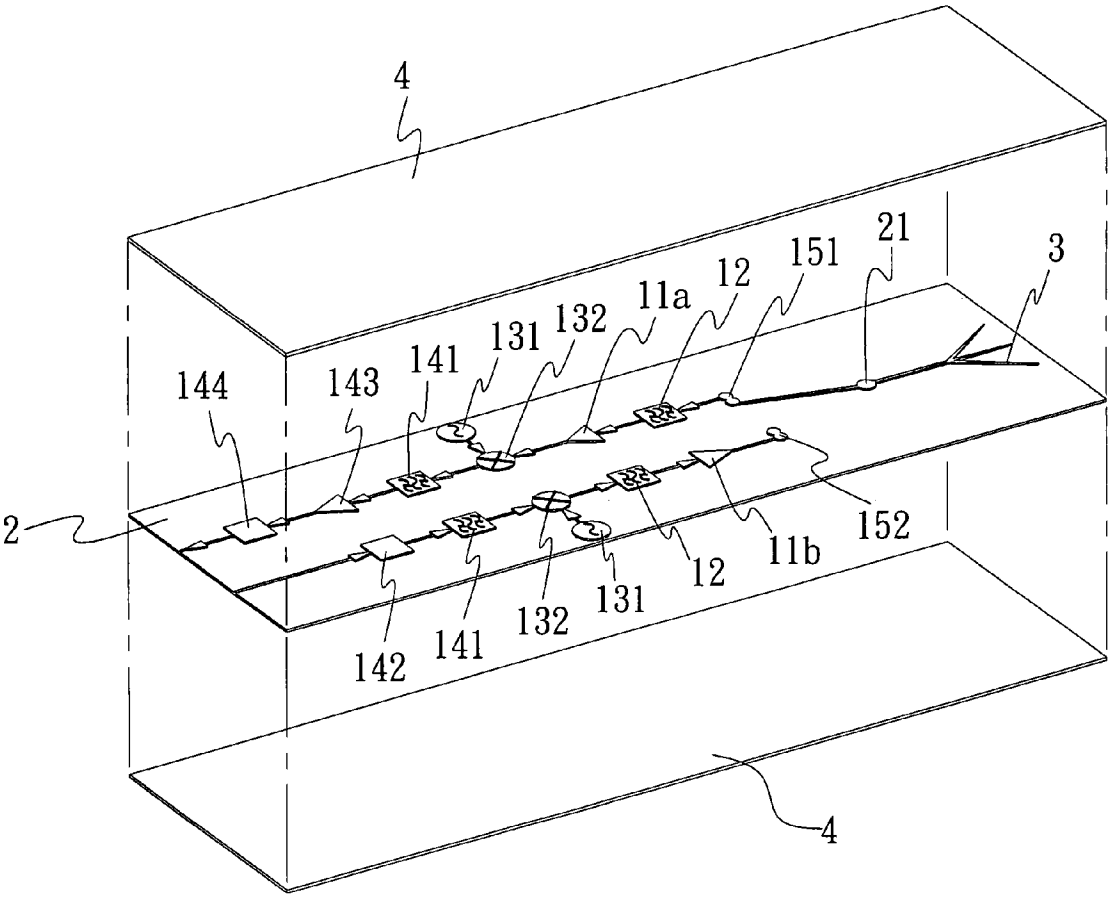
FIG. 1 is a perspective view of the embodiments of the invention.
Figure 2:
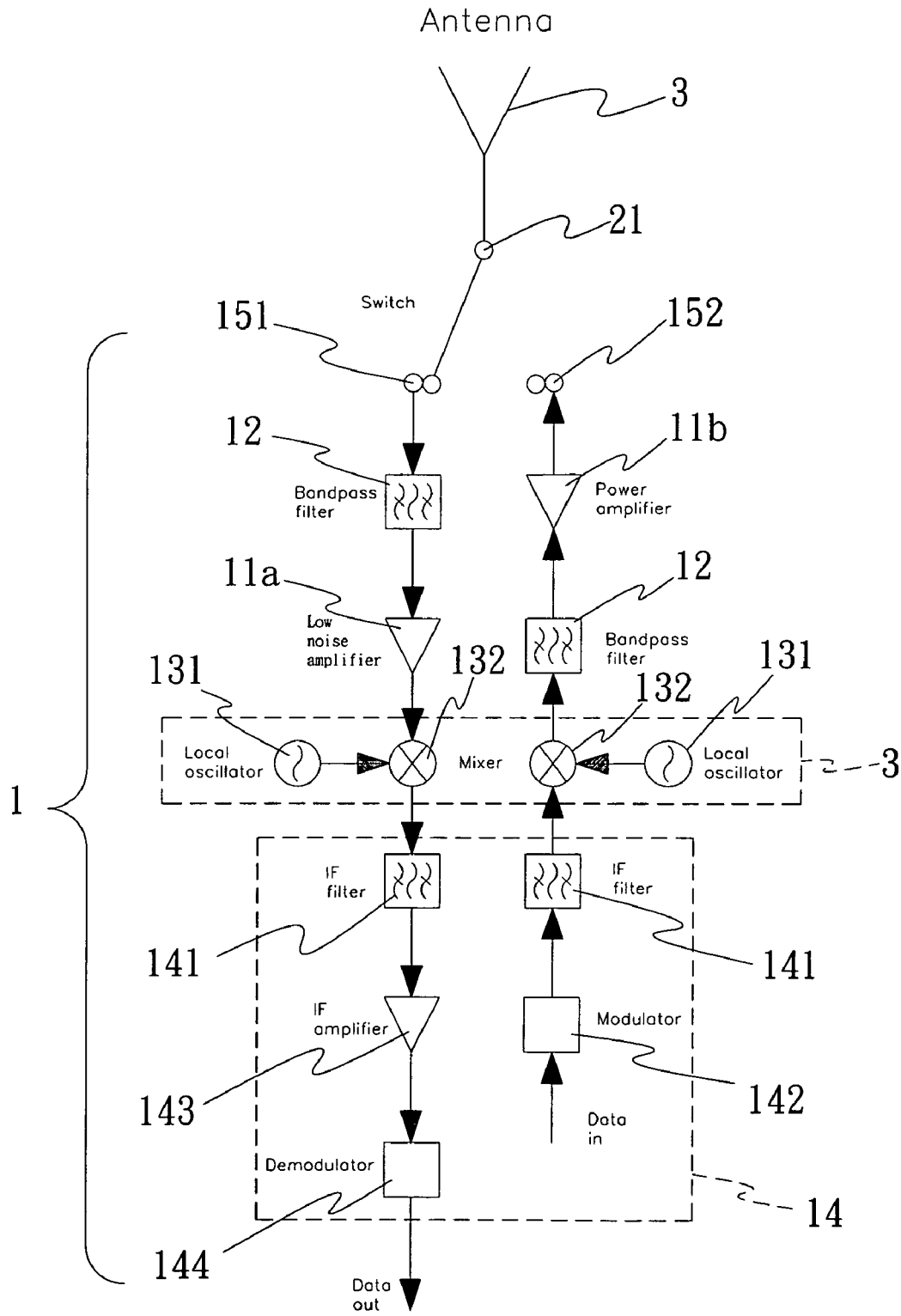
FIG. 2 is a cross-sectional view for the embodiments and the material of the package of the present invention.

FIG. 1 and FIG. 2 illustrate the structure of the present invention, which is a SOC capable of integrating a micro-antenna. The present invention includes a radio frequency model 1, a circuit board 2 and an antenna element 3 so as to form a single SOC.

Referring to FIG. 2, the radio frequency model 1 includes active elements or passive elements according to the requirement in design. These elements include a Low noise amplifier 11*a*, a power amplifier, a band pass filter 12, a processor 13 and a base band processor 14 so as to form a bi-directional transmission element. A switch is set between the antenna element 3 and the radio frequency model for bi-directionally changing the path of data transmission. These active or passive elements include a low noise amplifier 11*a*, a power amplifier 11*b*, a local oscillator 131, a mixer 132, an intermediate frequency filter 141, a modulator 142, an intermediate frequency amplifier 143 and a demodulator 144.

According to above mentioned bi-directional wireless transmission, the active and passive elements for data shooting include a band pass filter 12, a low noise amplifier 11*a*, a local oscillator 131, a mixer 132, an intermediate frequency amplifier 143 and a demodulator 144. The active and passive elements for data receiving include a power amplifier 11*b*, a band pass filter 12, a local oscillator 131, a mixer 132, an intermediate frequency filter 141 and modulator 142.

The printed circuit board 2 has a logic circuit and an antenna element 3 to provide the linkage for these active and passive elements of radio frequency model 1.

The antenna element 3 forms a micro-antenna element by antenna radiated conductor paths which composes of a single-feeding end or multiple-feeding ends and multiple-curved paths.

While using above elements after selecting a radio frequency IC and active and passive elements, in the present invention, the antenna element 3 and relative circuits are arranged on the printed circuit board 2. Then, by the process of embedding type injection molding or glue-filling modeling, the two surfaces of the printed circuit board 2 are covered by package material 4. Referring to FIG. 2, the single SOC is finished finally by the package of a radio frequency model and an antenna element.

The dielectric constant of above printed circuit board 2 is preferable to be between 2 to 30. Besides, the antenna element 3 is established by the combination of various methods, such as exposure, development, etching, electroplating or non-electroplating. The antenna element 3 is built on the printed circuit board 2 to form the micro-chip. The printed circuit board 2 contains one welding spot 21 (i.e. feeding end) which passes through the printed circuit board 2. The alternative way is to drill holes in the printed circuit board 2 and construct the extending conductor loop for increasing the length of the conductor. Then the package material 4 capable of fine-adjusting the dielectric constant thereof is easily packaged as a conductor loop by embedding type injection molding or glue-filling modeling. Finally, the single SOC composing of the radio frequency model 1 and the antenna element 3 is packaged.

The above-mentioned package material 4 capable of fine-adjusting the dielectric constant thereof easily is processed into thermal plastic high molecular materials, or thermal setting high molecular materials, and ceramic powders or fiber with various components and ratios. The dielectric constant is adjusted by adjusting the components and ratios.

Figure 3:
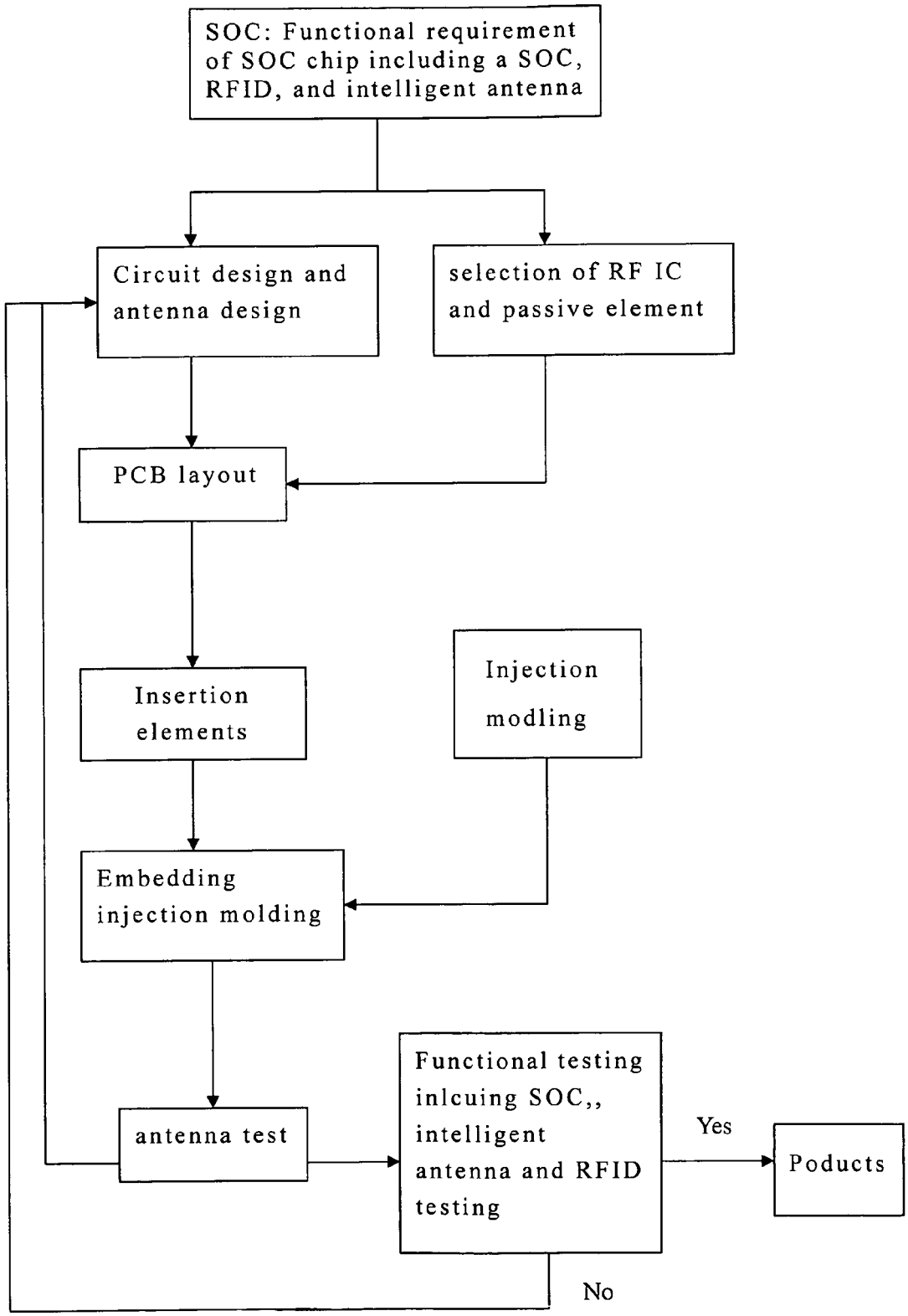
FIG. 3 is a flow-chart of the manufacturing process.

FIG. 3 is a flow-chart about the manufacture process of the present invention. This invention is about a single SOC with the functions of integrating SOC, a radio frequency identification (RFID) and a reconfigurable antenna. During the manufacture process, an injection mold is prepared in advance in order to offer the need of the manufacturing process of embedding type injection molding. After the molding, it is necessary to pass the antenna test and test of chip functions, then the product can be confirmed. If the product is not confirmed, then it must be returned to the manufacture process and will be re-designed or re-manufactured.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A SOC integrated with a micro-antenna comprising:

a radio frequency model including at least one of active and passive elements; and a circuit board having a logic circuit and an antenna element and providing the linkage for setting of the above-mentioned radio frequency model; and an antenna element having a single-feeding end or multiple-feeding ends and multiple-curved paths forming a micro-chip element; and wherein using above elements after selecting a radio frequency IC and active and passive elements, by using the antenna element and relative circuits to be arranged on the circuit board, through the packaging process, the upper and lower surface of the circuit board being covered by package material, the single SOC being finished finally by the package composing of a radio frequency model and an antenna element.

2. The SOC integrated with a micro-antenna as claimed in claim 1, wherein a switch is set between the antenna element and the radio frequency model for bi-directionally changing the paths of data transmission.

3. The SOC integrating with a micro-antenna as claimed in claim 1, wherein the radio frequency model is suitable in bi-directional wireless data transmission with predetermined active and passive elements, and include a band pass filter, a low noise amplifier, a local oscillator, a mixer, an intermediate frequency amplifier and a demodulator; the active and passive elements for data receiving include a power amplifier, a band pass filter, a local oscillator, a mixer, an intermediate frequency filter and a modulator.

4. The SOC integrated with a micro-antenna as claimed in claim 1, wherein the printed circuit board uses embedding type injection molding to the manufacturing process of package.

5. The SOC integrated with a micro-antenna as claimed in claim 1, wherein the circuit board uses the process of glue-filling modeling to the manufacturing process of the package.

6. The SOC integrated with a micro-antenna as claimed in claim 1, wherein the dielectric constant of the circuit board is between 2 to 30.

7. The SOC integrated with a micro-antenna as claimed in claim 1, wherein the antenna element is established by the methods selected from at least one of exposure, development, etching, electroplating and non-electroplating and the combinations thereof; and the antenna element is built on the circuit board to form a micro-chip.

8. The SOC integrated with a micro-antenna as claimed in claim 1, wherein the circuit board contains one welding spot as a feeding end which passes through the circuit board.

9. The SOC integrated a micro-antenna as claimed in claim 1, wherein the holes are drilled through the circuit board and the extending conductor loop is constructed for increasing the length of the conductor.

10. The SOC integrated with a micro-antenna as claimed in claim 1, wherein the package material capable of fine-adjusting the dielectric constant thereof is processed into thermal plastic high molecular materials, or thermal setting high molecular materials, and ceramic powders or fiber with various components and ratios; the dielectric constant is adjusted by adjusting the components and ratios.

11. The SOC integrated with a micro-antenna as claimed in claim 1, wherein the package material is the resin-ceramic compound material.

* * * * *